United States Patent [19]

Mondon

[11] Patent Number: 4,604,840

[45] Date of Patent: Aug. 12, 1986

[54] DOUBLE GLAZING AND A PROCESS FOR OBTAINING IT

[76] Inventor: Charles Mondon, 7 bis avenue du Général Leclerc, 91330 Yerres, France

[21] Appl. No.: 593,387

[22] Filed: Mar. 26, 1984

[30] Foreign Application Priority Data

Mar. 28, 1983 [FR] France ..... 83 05053

[51] Int. Cl.[4] ..... E06B 7/12

[52] U.S. Cl. ..... 52/172; 52/788; 52/398

[58] Field of Search ..... 52/788, 776, 479, 171, 52/172, 173 R, 398, 397, 741, 789, 304; 49/425

[56] References Cited

U.S. PATENT DOCUMENTS

| | | | |
|---|---|---|---|
| 2,207,745 | 7/1940 | Lipsett | 52/304 |
| 2,915,793 | 12/1959 | Berg | 52/172 |
| 3,210,809 | 10/1965 | Streeter | 49/64 |
| 3,425,163 | 2/1969 | Horgan, Jr. | 52/788 X |
| 3,896,589 | 7/1975 | Mitchell | 139/436 |
| 4,065,894 | 1/1978 | Day | 52/171 |

FOREIGN PATENT DOCUMENTS

| | | | |
|---|---|---|---|
| 0029984 | 11/1980 | European Pat. Off. | 52/171 |
| 1226767 | 3/1961 | Fed. Rep. of Germany | 52/171 |
| 1937469 | 7/1969 | Fed. Rep. of Germany | 52/788 |
| 2041038 | 2/1971 | Fed. Rep. of Germany | 52/788 |
| 2350602 | 4/1975 | Fed. Rep. of Germany | 52/171 |
| 2730119 | 2/1979 | Fed. Rep. of Germany | 52/171 |
| 2305890 | 3/1982 | Fed. Rep. of Germany | 52/171 |
| 1079037 | 11/1954 | France | 52/171 |
| 1215281 | 4/1960 | France | 52/788 |
| 1433252 | 5/1965 | France | 52/788 |
| 2278896 | 3/1974 | France | 52/788 |
| 7910288 | 4/1979 | France | 52/788 |
| 2412238 | 8/1979 | France | 52/788 |
| 2420014 | 11/1979 | France | 52/172 |
| 522813 | 6/1972 | Switzerland | 52/788 |

OTHER PUBLICATIONS

Cahiers Du Centre Scientifique Et Technique Du Batiment, No. 229, mai 1982, Paris (FR), Avis No. 6/81-164: "Therphoverre", pp. 1-8, p. 6, FIGS. 3,4, point 4.11; p. 7, point 4.13.

*Primary Examiner*—Carl D. Friedman
*Assistant Examiner*—Naoko N. Slack
*Attorney, Agent, or Firm*—Burns, Doane, Swecker & Mathis

[57] ABSTRACT

A glazing consisting of two panes located opposite one another and retained by a rigid frame provided with leakproofing means and consisting of sections which bear on the inner faces of the panes and which are fastened to these by means of an anchor preventing the panes from moving apart, this frame being provided with at least one deformable and leakproof member for equalizing pressure between the outside and inside of the glazing, this member being independent of the said leakproofing means and being located on the inside of the glazing in relation to the said sections, and the said sections having, towards the outside of the glazing, a shape which allows direct attachment of accessories enabling the glazing to interact with a fixed surround.

This glazing provides a considerable increase in the internal volume and therefore the possibilities of heat and sound insulation, as a result of the fitting of interpolated elements. Furthermore, it can be produced completely at the factory, ready to be installed in its surround.

11 Claims, 7 Drawing Figures

DOUBLE GLAZING AND A PROCESS FOR OBTAINING IT

BACKGROUND OF THE INVENTION

The present invention relates to a glazing, especially for windows and French windows, of the type consisting of two panes located opposite one another and retained by means of a rigid frame provided with leakproofing means.

More specifically, the invention relates to a glazing of the type indicated, which is provided with a deformable and leakproof member for equalizing pressure between the outside and the inside, this word designating, here, the space contained between the two panes.

The pressure variations between the outside and inside of a double glazing can be attributed to meteorological phenomena or to heating of the gas contained inside under the effect of the sun. To prevent them from causing damage, it is customary to give the panes sufficient thickness and embed them firmly in the frame. It should be noted that the larger the glazing, the more the frame is subjected to stress: if the dimensions of a square glazing are doubled, the forces attributed to the differences in pressure are quadrupled, whilst the length of the frame is merely doubled.

There has been a proposal (U.S. Pat. No. 2,207,745) to equalize the pressures by means of holes provided, if aporopriate, with filters, but this solution is not entirely effective in eliminating the condensation arising from moisture inside the glazing.

There has also been a proposal (DE-A No. 2,730,119) to place between the panes and the frame an element made of deformable material, such as rubber. This element constitutes the leakproofing means anchoring the panes to the frame, and between the panes it forms a flexible diaphragm, one face of which is in contact with the outside air and the other face in contact with the inside of the glazing and which is deformed under the effect of the relative pressure variations. The disadvantage of this solution is that it gives rise to forces exerted on the part of the element forming the leakproofing means, with the attendant risks of fatigue or displacement.

The document U.S. Pat. No. 4,065,894 describes a glazing, the frame of which, preferably made of wood, contains in its thickness a receptacle which communicates with the outside via a duct.

Located within this receptacle is a bladder or vessel made of flexible material, the interior of which is connected to the inside of the glazing by means of a tube. This tube passes through a gasket made of elastomeric material, which serves both to provide leakproofing between the frame and the inside of the glazing and to prevent the panes from moving closer to one another. The frame has a groove in which the edges of the panes and the elastomer gasket are accommodated, the edges of this groove preventing the panes from moving apart.

This device makes it possible to achieve effective equalization of the pressures inside and outside, but it makes it necessary to provide a bulky frame. In fact, on the one hand, the frame must be large enough to contain the cavity in which the bladder is located, and this cavity must allow variations in volume of the bladder; these variations in volume increase if the distance between the panes increases. On the other hand, since the panes are retained by means of a groove, the frame necessarily has a width greater than the distance between the outer faces of the panes. For these two reasons, it becomes necessary to limit the distance between the panes, but this reduces the heat-insulation qualities of the glazing.

There has, moreover, been a proposal for arrangements in which the panes of a glazing are bonded to a "spacer" section located between them (FR-A No. 1,433,252), the glazing being without any pressure-equalizing member. It seems possible, by using this technique, to reduce the forces exerted on the frame which are attributed to internal excess pressure and therefore to reduce its thickness, but there has never been a proposal to locate such glazing other than within grooves provided within the frame. This system would therefore make it possible, in theory, to increase the distance between the panes for a given thickness of the frame, but the latter nevertheless still has a thickness greater than the distance between the outer faces of the panes. On the other hand, this system scarcely makes the process of obtaining and installing the glazing any simpler.

Furthermore, it is conventional to fasten to the frames various accessories enabling the glazing to interact with a fixed surround, for example hinges, bearings, leakproofing means and lock components. This has been done for a very long time with wooden frames and single panes, and the technique has simply been modernized for glazing with multiple planes and metallic or like frames, having a shape which allows various accessories to be attached.

The end result of this is a costly construction, because it involves several stages, some carried out at the factory and others on site.

The object of the invention is to provide a glazing which, at the same time, has a higher quality than those of the prior art in terms of its heat-insulation properties, because of an increased distance between the panes, and is simpler to obtain and has a reduced cost price.

The object of the invention is also to provide a simple process for obtaining such a glazing.

BRIEF DESCRIPTION OF THE INVENTION

The invention thus provides a glazing consisting of two panes located opposite one another and retained by means of a rigid frame provided with leakproofing means, this frame being provided with at least one deformable and leakproof member for equalizing pressure between the outside and inside of the glazing, this member being independent of the said leakproofing means, the particular feature of the glazing being that:

The frame consists of sections which bear on the inner faces of the panes and which are fastened to these by means of an anchor which prevents the panes from moving apart from each other.

the pressure-equalizing member is located inside the glazing in relation to the said sections, the sections have, towards the outside of the glazing, a shape allowing direct attachment of accessories enabling the glazing to interact with a fixed surround.

Anchor refers, here, to a non-mechanical means ensuring that the pane is fastened permanently to the section, for example, bonding. The anchor can also perform a leakproofing function, but it can be advantageous to provide an additional leakproofing means, for example made of a material having high leakproofing in respect of water vapor.

The combination of the elements which have just been mentioned provides the following advantages:

The fact that the sections constituting the frame are anchored to the inner face of the panes makes it possible to move the panes apart until their outer faces are in the planes defining the limits of the overall dimensions of the glazing; in other words, the distance between the panes is the maximum possible for a total glazing thickness which is otherwise fixed.

This results in a considerable increase in the volume of the inner space and therefore the possibilities of heat and sound insulation of the glazing, as a result of the fitting of interpolated elements.

The fact that the pressure-equalizing member is located inside the glazing makes it possible to install it at the factory, whilst avoiding the problems of mechanical protection of this member during transport and during the fastening of various accessories. It also makes it possible to reduce the weight and simplify the sections of the frame.

The fact that the same section combines the "spacer" functions with that of supporting the accessories results in a substantial simplification of construction and a lowering of the cost. It is possible, in fact, to produce the "self-supoorting" glazing, together with its accessories, directly at the factory, the work on site being confined to installing it in its surround.

As has been seen, this result can be achieved only as a result of the interaction of the various elements of the invention.

According to a preferred method of production, the sections constituting the frame are contained completely in the gap defined by the planes of the outer faces of the panes.

Preferably, a means for protecting the pressure-equalizing member against radiation penetrating through the panes is provided, this protection means dividing the inner space of the glazing into two communication chambers which are subjected to the same pressure and one of which is peripheral and contains the said equalizing member. This protection means delimits the periphery of the glazing and the part of the latter which is transparent to light. Its main use is to lengthen the useful life of the pressure-equalizing member. This member is constantly stressed mechanically during the lifetime of the glazing, and it is necessary to prevent the action of solar radiation from reducing its flexibility and leakproofing. The protection means also has an aesthetic use, since it conceals the protection means from sight.

Advantageously, the said protection means consists of at least one auxiliary section which is supported, with play, by two wings of a frame section and which, if appropriate, carries additional devices located inside the glazing.

According to another very advantageous method, the peripheral chamber contains, in addition to the equalizing member, a filler consisting of a dehydrating substance, and near the said filler of dehydrating substance there is in one section at least one orifice provided with a means of leakproof sealing, which can be removed in order to renew the said filler.

The said protective section thus ensures, in addition to the protection of the pressure-equalizing member, the concealment of the dehydrating filler and, if appropriate, its retention. It is clear that this filler must be arranged so as not to impair the function of the equalizing member. It will be noted, in this respect, that the quantity of water vapor penetrating into a double glazing depends essentially on the length of the gaskets and not on the volume between the panes. Consequently, when the distance between the panes increases, there is no change in the quantity of dehydrating substance. The filler can therefore be arranged so as to mask a smaller part of the glazed surface.

On the other hand, since the filler is renewed by a means independent of the pressure-equalizing member, there is no risk that the latter will be damaged during the operation.

Another advantage of the arrangement described is that it is possible to ensure that bearing boxes or other accessories enabling the glazing to interact with a fixed surround and carried by a section penetrate into the said chamber, but without impairing its leakproofing relative to the outside.

This method becomes possible both because of the greater distance between the panes, which exceeds the thickness of a bearing box, and because the frame sections combine the "spacer" function with the function of supporting the accessories. It will be noted that, to ensure good leakproofing, the bearing boxes and similar accessories will advantageously be installed at the factory.

The invention also provides a process for producing a glazing such as that which has just been defined.

This process is of the type according to which the sections are joined by bonding to one another and to the two panes, thus forming a leakproof assembly, its particular features being that the sections are provided beforehand with the pressure-equalizing member or members, and after bonding a pressure difference is produced between the two faces of the equalizing member or members by means of a sealable orifice provided in one section and communicating with the interior of the glazing, this pressure difference being so calculated that the average shape of said equalizing member or members during use will be intermediate between its extreme shapes, and communication between the interior of the glazing and the outside is sealed off at least up to the moment when the glazing is used.

The simplest, but not the only way of carrying out the process is as follows: after bonding and installation of the dehydrating filler, a sealing-off device, for example that intended for the renewal of this filler, is removed or is not installed. The interior of the glazing is then in communication with the surrounding atmosphere which is advantageously a dry gas, such as nitrogen. The interior of the equalizing member is then brought to a different pressure which is calculated in a way described above. For this purpose, the duct intended for connecting the equalizing member to the atmosphere during its operation is connected to a suitable pressure source, for example a gas bottle, by means of a duct provided with a temporary sealing-off means. Subsequently, this sealing-off means is closed, as is the sealing-off device mentioned above. The two faces of the equalizing member are thus made independent of the atmosphere. At the time of installation at the place of use, for example, in the hills, it is sufficient to open or remove the temporary sealing-off means.

BRIEF DESCRIPTION OF THE FIGURES

The invention will now be described in more detail by means of practical examples given in a non-limiting way and illustrated in the drawings of which.

DETAILED DESCRIPTION OF THE PREFERRED EMBODIMENT

Figure 1:
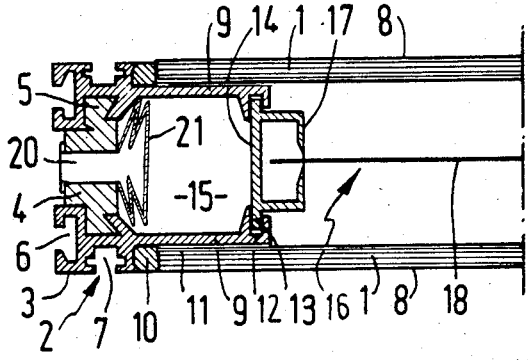
FIG. 1 is a cross-section of one edge of a glazing according to the invention, showing the equalizing member in the case of an internal excess pressure.

In all the Figures, the same reference symbols denote similar articles. The glazing which is the subject of FIG. 1 is formed from two rectangular and identical panes 1 which are connected at their edges by frame sections 2 all having substantially the same structure.

Each frame section 2 is composed of two identical aluminum sections 3 arranged symmetrically and connected by a central core 4 made of resin and having low thermal and sound conductivity, this structure avoiding the appearance of a thermal bridge. By "aluminum" is meant, of course, a suitable aluminum alloy, the composition of which can vary according to the circumstances of use. Other metals can, of course, be used. It would be possible, naturally, to design the frame section 2 in one piece of a material which has suitable mechanical and heat and sound insulation properties.

Each aluminum section 3 has a dovetail groove 5 for anchoring the core 4, the latter being installed by casting.

In the vicinity of the core 4, the aluminum sections 3 possess, in an opposite direction to the panes 1 and in an opposite direction to the core 4, grooves 6, 7 which are intended for the attachment of accessories which are to interact, for example with fixed woodwork, such as a window or door casing.

The total width of the frame section 2 is substantially equal to the distance between the outer faces 8 of the panes 1.

The aluminum sections 3 each have a wing 9 which projects between the panes 1 and which gives the cross-section of the frame section 2 a general U-shaped form. The panes 1 are fastened via their edge to the frame section by means of a gasket 10 which is made of extruded silicone and which provides a flexible anchor and a first leakproofing barrier in respect of water vapor. Furthermore, a strip 11 made of hot-extruded butyl is interposed and clamped between each wing 9 and the inner face of the corresponding pane 1, so as to form a second barrier against water vapor.

The end of each wing has a groove 12 on its face turned inwards. A projection 13 of an auxiliary section 14 made of polyvinyl chloride penetrates into each of these grooves. It is important to note that the projections 13 penetrate into each groove 12 with a considerable play both in a parallel direction and in a direction perpendicular to the panes. This auxiliary section is never perfectly plane because of the temperature differences between its faces. Furthermore, its length is a little less than that of the section 2, to allow for the difference between the coefficients of expansion. For these reasons, the connection between the frame section 2 and the auxiliary section 14 is never leakproof.

Figure 2:
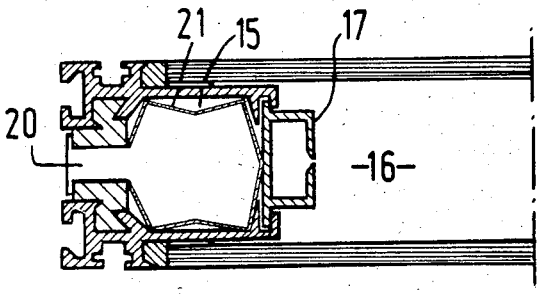
FIG. 2 is a section similar to that of FIG. 1, but in the case of an external excess pressure.

The auxiliary section 14 divides the inner space defined by the panes 1 and the sections 2 into a peripheral chamber 15 and a central chamber 16 (FIG. 2). These two chambers are always in communication for the reasons which have just been explained.

The auxiliary section 14 carries, on its face opposite the frame section 2, two wings 17 of right-angled cross-section, the ends of which are narrowed and brought close to one another. In FIG. 1, these two wings 17 retain between them a stretched anti-convection film 18 made of clear or tinted transparent material. In FIG. 2, the two wings 17 are not used, whereas in FIG. 3 they retain a third pane 19.

The core 4 of the section 2 is perforated with a hole 20 in which is fastened in a leakproof manner a pocket 21 in the form of a bellows, which is made of butyl with a thickness of 0.3 to 1.5 mm and which is shown in FIG. 1 substantially in its position of least volume and in FIG. 2 in its position of greatest volume, this pocket constituting the pressure-equalizing member. The interior of the pocket 21 communicates with the outside atmosphere via the hole 20, whilst its outer face is subjected to the pressure prevailing in the chambers 15 and 16, that is to say to the pressure inside the glazing.

The situation shown in FIG. 1 thus corresponds to an internal excess pressure, or more exactly to conditions which would lead to excess pressure in the absence of any pressure-equalizing member. As shown in the figures, the frame section 2 and the auxiliary section delimit the space in which this member can take effect, and at the same time they prevent solar or suchlike radiation, which would have passed through the panes, from being able to reach the pocket 21.

Figure 3:
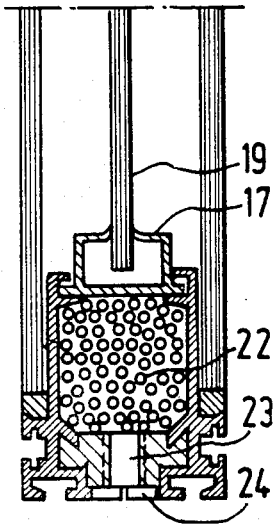
FIG. 3 is a section similar to that of FIG. 1, but at the level of the dehydrating material.

FIG. 3 shows the chamber 15 occupied not by the pocket 21, as in FIGS. 1 and 2, but by a mass 22 of dehydrating material consisting here, of a molecular sieve in the form of granules.

Of course, transverse partitions (not shown) prevent this dehydrating material from coming up against the pocket 21 and preventing it from functioning freely. A hole 23 passes through the core 4 of the section. This hole is threaded and is sealed off by a leakproof screw plug 24. The removal of the plug 24 and extraction of the mass 22 by means of suction or drawing off are normally carried out only when this mass is spent and must be changed, that is to say after a period of time which, here, is of the order of ten years.

Figure 4:
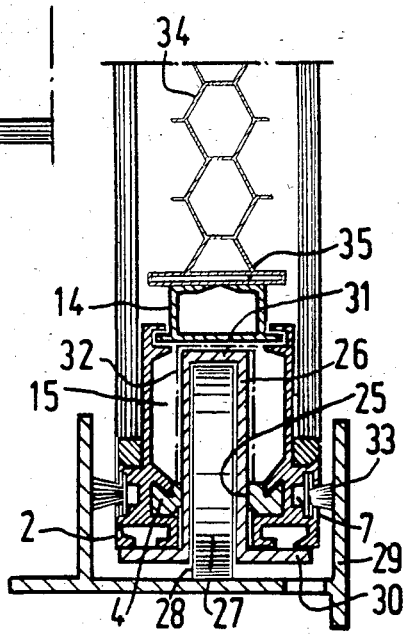
FIG. 4 is a vertical section of the lower edge of a glazing provided with accessories for use as a slicing panel or a screen.

FIG. 4 shows the position of accessories enabling the glazing according to the invention to be used as sliding glazing. Only the core 4 of the frame section is modified in comparison with the preceding Figures. In fact, this core 4 incorporates elongated notches 25 in which boxes 26 provided with bearings 27 are mounted. Each box 26 is closed and leakproof except on the side facing outwards, via which the bearings 27 project so as to roll on a bearing race 28 which is part of a fixed surround 29. The box 26 possesses wings 30 which bear on the ends of the frame section 2. The bottom 31 of the box comes near to the auxiliary section 14 to such an extent that practically the entire extent of the peripheral chamber 15 in the direction of the center of the glazing is used. The connection between the box 26 and the core 4 of the frame section, at the level of the notch 25, is leakproof. In an alternative form, it is possible for the box 26 carrying the bearings to be removable and for it to be surrounded in the peripheral chamber 15, by a second box 32 which is leakproof and which is connected to the core 4 in a leakproof manner. The second box 32 is shown by dashes in FIG. 4. It can be thinner than the box 26 because it does not experience mechanical forces. This alternative form is a little more complicated, but it allows the bearings to be replaced and adjusted easily. It will be noted that either of these arrangements becomes possible, without difficulty, because of the great distance between the panes. Thus, the transparent surface of the glazing extends practically up to the top of the box 26.

FIG. 4 also shows leakproofing brushes 33 mounted in the grooves 7 of the frame section 2. These brushes are the only elements which project beyond the plane of the outer faces 8 of the panes 1. They ensure leakproofing in respect of drafts, as is well known, and protect the panes 1 from contact with the fixed surround 29.

The same FIG. 4 shows the lower part of a foldable screen 34 which acts as a sun shield and is preferably reflecting. The large spacing between the panes makes it possible to give the screen 34 a structure which, in cross-section and when it is unfolded, shows a series of superimposed honeycombs.

The screen 34 is stretched downwards by means of a section 35 which, in FIG. 4, rests on the wings 17 of the section 14. The vertical edges of the screen 34 are guided by the wings 17 of the section 14 located on the sides of the glazing.

Figure 5:
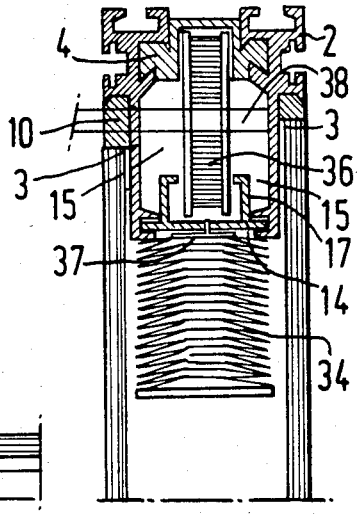
FIG. 5 is a vertical section of the top of a glazing showing a screen folded up.

FIG. 5 shows the upper edge of a glazing equipped with the same screen 34 which, this time, is shown in the folded up state. This time, the peripheral chamber 15 is used for accommodating a pulley 36 driving cables for raising and lowering the screen.

The core 4 is notched to leave the space required for the pulley 36, but the notch is not a through-notch, so as to maintain leakproofing. To reduce the bulk of the screen 34 when it is folded up, the auxiliary section 14 is reversed, its wings 17 being on the inside of the peripheral chamber 15. These wings are cut away at the level of the pulley 36 to leave room for the latter. Moreover, the auxiliary section 14 carries the means 37 for attaching the screen 34.

The shaft 38 of the pulley 36 is supported by the aluminum sections 9 of the frame section, without interrupting the leakproofing.

In the alternative form illustrated in FIG. 5, the shaft 38 passes through one of the sections 9 so as to be connected to external drive means (not shown) by means of a leakproof gasket consisting of a widened portion of the silicone gasket 10. In another alternative form (not shown) which is more costly, but more reliable as regards leakproofing, the large width of the chamber 15 is utilized to accommodate in it a miniature drive motor, the supply cables of which pass through the frame section 2 via a leakproof gasket.

Figure 6:
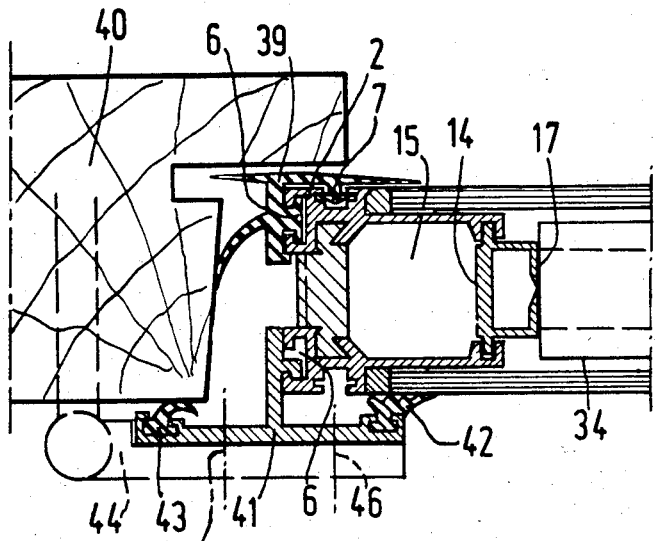
FIG. 6 is a horizontal section of the edge of a glazing provided with accessories for use as a casement window.

FIG. 6 shows how the grooves 6, 7 of the frame section 2 are used for retaining accessories enabling the glazing to be used as a swing door. On one side, a flexible outer leakproofing gasket 39 is anchored directly in the grooves 6 and 7 and bears on the fixed surround 40. On the other side, an additional section or swing section 41 is fastened in a groove 6 and carries an assembly gasket, or key gasket 42, which bears on the edge of the corresponding pane 1, and an inner leakproofing gasket 43 which bears on the fixed surround 40.

Dashes represent the hinge 44 which is screwed at 45 to the additional section and which is locked at 46 in the groove 7 of the frame section 2.

FIG. 6 also shows how the wings 17 of the auxiliary section 14 serve for guiding the screen 34 when it is unfolded. It is quite clear that the accessories shown in this Figure could have been fitted at the same time as an anti-convection screen, such as that shown in FIG. 1, or an additional pane, such as that shown in FIG. 3. It will be noted that the chamber 15, which is shown empty in FIG. 6, can contain a pressure-equalizing member or a dehydrating material or other accessories fastened to the core 4, and in fact the latter remains accessible without the removal or, if appropriate, with the removal of a single gasket 39, this being relatively easy.

Figure 7:
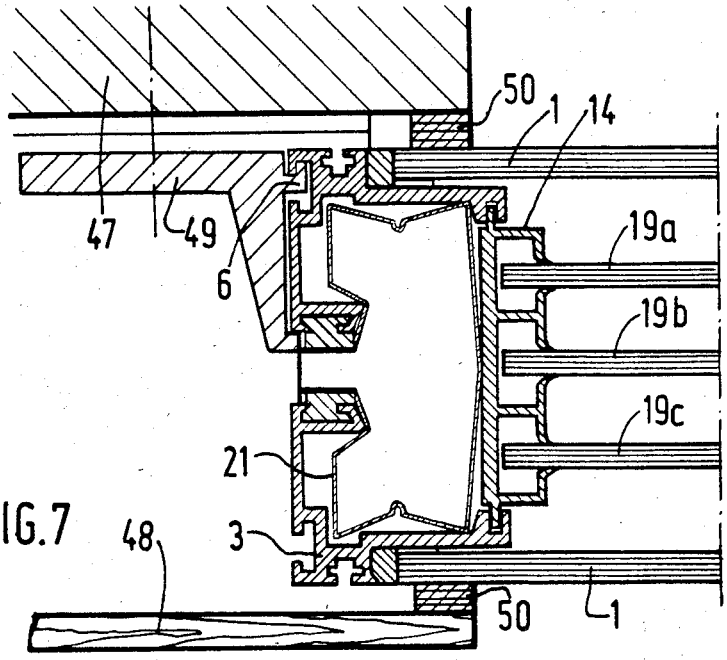
FIG. 7 is a section through the edge of another embodiment of the glazing according to the invention.

FIG. 7 shows another embodiment of the glazing according to the invention. Here, the thickness of the glazing is appreciably greater than in the preceding Figures because of a slightly different shape of the aluminum sections 3 and the auxiliary section 14, the other elements remaining the same. This has made it possible to accommodate a more voluminous pressure-equalizing member and to provide several additional panes 19*a*, 19*b* and 19*c*. It is also possible to provide several anti-convection screens, such as the screen 18. There are means, such as holes (not shown) in the section 14, to equalize the pressures in the compartments delimited by the additional panes or additional screens. It is likewise possible to provide several foldable screens, such as the screen 34, or combine several of these elements. The pressure-equalizing member 21 has increased dimensions and a modified form.

The glazing of FIG. 7 is shown directly associated with elements 47, 48 of the fabric of the building by means of a fastening piece 49, which interacts with a groove 6 and gaskets 50 bearing on the panes 1.

It is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

I claim:

1. A glazing comprising two panes located opposite one another and retained by a rigid frame provided with leakproofing means, said frame having sections which are contained completely in the gap defined by the planes of the outer faces of the panes, which sections bear on inner faces of the panes and which sections are fastened to the panes by an anchor preventing the panes from moving apart, said sections having wings and a shape toward the outside of the glazing which allows direct attachment of accessories so as to enable the glazing to interact with a fixed surround, said frame being provided with at least one deformable and leakproof member for equalizing pressure between the outside and inside of the glazing, said member being independent of said leakproofing means and being located on the inside of the glazing in relation to said sections, said frame being also provided with at least one auxiliary member being supported by said wings with projections of one of said auxiliary member and said sections penetrating into grooves of the other of said auxiliary member and said sections with clearance, said auxiliary member dividing the inner space of the glazing into two communicating chambers which are subjected to the same pressure, one of said chambers being peripheral and containing said pressure-equalizing member, said auxiliary member being so made and shaped as to enable said pressure-equalizing member to be wholly protected against the radiation penetrating through the panes, said pressure equalizing member being a pocket in the form of a bellows.

2. A glazing as claimed in claim 1, wherein the said peripheral chamber contains, in addition to the equalizing member, a dehydrating substance, and leakproof means for renewing said dehydrating substance.

3. A glazing as claimed in claim 2, wherein said glazing includes bearing boxes which extend into said first chamber.

4. A glazing as claimed in claim 1, wherein glazing includes bearing boxes which extend into said first chamber.

5. The glazing according to claim 1, wherein said auxiliary member is provided with means for supporting at least one additional device located inside the glazing.

6. A process for producing a glazing comprising the steps of: providing frame sections with a pressure-equalizing member in the form of a bellows; bonding the sections to one another and to two opposing panes to form a leakproof assembly; partitioning space enclosed by said panes and said frame into a first, peripheral chamber and a second chamber in communication with said first chamber by placing an auxiliary member between said sections with projections of one of said auxiliary member and said sections fitting grooves of the other of said auxiliary member and said sections with clearance; locating said pressure-equalizing member within said peripheral chamber so as to wholly protect the pressure-equalizing member against radiation penetrating said panes; after bonding, producing a pressure difference between the two faces of the equalizing member through a sealable orifice in one section and communicating with an interior of the glazing, this pressure difference being such that the average shape of said equalizing member during use will be intermediate between its extreme shapes and subsequently sealing off communications between the interior of the glazing and the outside at least up to the moment when the glazing is used.

7. A glazing comprising:

a pair of spaced apart panes;

a frame peripherally anchoring said panes, said frame including opposing sections which bear on inner faces of said panes, said frame including also an auxiliary member supported by said sections with projections of one of said auxiliary member and said sections fitting into grooves of the other of said auxiliary member and said sections with clearance, said auxiliary member partitioning space inside said glazing into a first, peripheral chamber situated between said opposing section members and a second chamber, said first and second chambers communicating with each other through said clearance;

a pressure-equalizing bellows located in said peripheral chamber, whereby said sections and said auxiliary member protect all of said bellows from radiation penetrating the panes;

passage means through said frame for communicating said bellows with an environment outside the glazing; and leakproofing gasket means for forming a water vapor barrier between said frame and said panes.

8. The glazing as claimed in claim 7, wherein said frame is within planes defined by outer faces of said panes.

9. The glazing as claimed in claim 7, wherein said frame has a shape toward the outside of the glazing which allows direct attachment of accessories so as to enable the glazing to interact with a fixed surround.

10. The glazing as claimed in claim 7, wherein said auxiliary member includes means for supporting devices inside the glazing.

11. A method of equalizing pressure within a glazing comprising spaced apart panes, said method comprising the steps of:

supporting peripheries of the panes with a frame having a generally U-shaped cross-sectional form, opposing sections of said frame being placed adjacent inner faces of the panes;

bonding said sections to said panes to form a leakproof assembly;

partitioning space enclosed by said panes and said frame into a first, peripheral chamber and a second chamber in communication with said first chamber by supporting an auxiliary member between said sections with clearance;

locating a pressure-equalizing bellows in said first chamber so as to protect all of said bellows against radiation entering the glazing through said panes; and communicating said bellows with an environment outside said frame through said frame.

* * * * *